US005638839A

United States Patent [19]

Montoli

[11] Patent Number: 5,638,839

[45] Date of Patent: Jun. 17, 1997

[54] DUAL HINGED REFILLABLE COSMETIC CASE

[75] Inventor: Antonio Montoli, Brookfield, Conn.

[73] Assignee: Risdon Corporation, Naugatuck, Conn.

[21] Appl. No.: 529,430

[22] Filed: Sep. 18, 1995

[51] Int. Cl.[6] ..... A45D 33/22

[52] U.S. Cl. ..... 132/295; 132/294; 132/314; 132/315; 132/298; 206/5.81; 220/324; 220/335; 220/255; 220/259

[58] Field of Search ..... 132/294, 295, 132/296, 298, 299, 301, 303, 304, 305, 314, 315; 206/581, 804, 823; 220/324, 326, 335, 343, 254, 255, 256, 259

[56] References Cited

U.S. PATENT DOCUMENTS

| | | | |
|---|---|---|---|
| 1,635,891 | 7/1927 | Kendall | 132/295 |
| 1,735,483 | 11/1929 | Wacker | 132/294 |
| 2,535,455 | 12/1950 | Reilly | 132/315 |
| 4,589,430 | 5/1986 | Sussman | 132/315 |
| 4,696,317 | 9/1987 | Shioi et al. | 132/314 |
| 4,826,014 | 5/1989 | Schefer | 132/303 |
| 4,972,860 | 11/1990 | Yuhara et al. | 132/301 |
| 5,199,451 | 4/1993 | Montoli | 132/315 |
| 5,320,116 | 6/1994 | Ackermann | 132/293 |

*Primary Examiner*—Gene Mancene
*Assistant Examiner*—Pedro Philogene
*Attorney, Agent, or Firm*—St. Onge Steward Johnston & Reens

[57] ABSTRACT

A refillable cosmetic case has a base with a recess for a releasable tray held in place by a tray retaining cover hinged in the base and having a latching element. The case lid has a rear edge and is hinged to the base at an edge opposite the tray cover hinge, and the lid rear edge can be associated with the tray to assist in its removal whereby when the lid is opened beyond its usual limit of travel the rear edge releases the latching element and thus the tray retaining cover. The cover pivots back on its hinge, so the tray can be lifted out and refilled or replaced.

13 Claims, 4 Drawing Sheets

DUAL HINGED REFILLABLE COSMETIC CASE

TECHNICAL FIELD

This invention relates to cosmetic cases, particularly to compacts having a refillable tray.

BACKGROUND OF THE INVENTION

There are a number of previously described refillable compacts, most of which involve manually pressing a button or tab or manipulating a retaining lid or frame to release the interior cosmetic tray.

In U.S. Pat. No. 1,635,891, Kendall disclosed a case having a swinging ejector bar extending across the bottom of the case under a plate carrying face powder, rouge or other cosmetic. The bar was attached on one side with a knuckle that could be pressed to dislodge the bar, thus ejecting the compact plate resting on it.

Wacker disclosed a frame member hinged to the bottom of a cosmetic box; the member frictionally engaged a rouge pan holder when folded (U.S. Pat. No. 1,735,483). In U.S. Pat. No. 2,535,455 to Parkin, a compact with an inner door held in powder that could be replenished. A case patented by Sussman had a cosmetic holder that simply snapped into place inside the compact (U.S. Pat. No. 4,589,430).

In U.S. Pat. No. 5,199,451 to Montoli, a compact with a pop-up tray operated by a hinged cover was disclosed. The tray was adapted to sit in the compact frame and snap into place. The hinge was designed so that when the compact was forced open beyond its normal open position, the tray was forced up so that it could be replaced.

Ackerman, et al., disclosed a cosmetic compact that had an unlatching slide with a button surface; the hinged cover was held closed by a detent (U.S. Pat. No. 5,320,116). Light finger pressure on the butten caused a cam to force open the cover, disengaging the cover detent, and heavy finger pressure forced the powder tray up, disengaging it.

It would be desirable to have an alternative mechanism for readily removing a cosmetic tray from its case so that the tray can be replaced or refilled with fresh cosmetic materials such as powder or eye shadow. It would be especially desirable to have a refillable compact that is so easy to refill that a weak, aged, arthritic, or disabled person can do it.

SUMMARY OF THE INVENTION

It is an object of the invention to provide a refillable cosmetic case that can be refilled quickly and easily.

This and other objects are provided by the present invention which describes a refillable cosmetic case that has a dual hinge arrangement, with one hinge holding the lid to the base and a second interior hinge holding a cosmetic tray retaining cover to the base inside the case in a closed position. The case has an open base having an upwardly facing recess, a cosmetic tray releaseably retained in the recess, and a tray retaining cover hinged in the base and having a latching element to hold the tray retaining cover in a closed position. A case lid is hinged to the base at an edge opposite the tray retaining cover hinge. The lid has a cam means that releases the latching element and the tray retaining cover in an open position, so that the tray can be removed from the base and refilled or replaced.

In a preferred embodiment of the invention, the cosmetic case consists of four pieces: a lid, a tray retaining cover, a cosmetic tray, and a base. The tray retaining cover, which can swing back on pins fitted into orifices in the base and expose the tray, is hinged to the base near the front of the case. Opposite this interior hinge at the rear of the case, the cover has an edge bearing a perpendicular member which has a flange that meshes with a corresponding flange on the rear of the tray recess in the base, forming a latch to the base in a closed position. When the case is opened, the rear edge of the case lid comes in contact with the underside of the tray cover near the latch, limiting the usual travel of the lid. If the lid is opened beyond this point, its rear edge lifts the tray cover, releasing the cover latch and exposing the tray for refilling or replacement.

Other objects, aspects and features of the present invention in addition to those mentioned above will be pointed out in or will be understood from the following detailed description provided in conjunction with the accompanying drawings.

DETAILED DESCRIPTION OF THE INVENTION

As illustrated in FIGS. 1 to 4, this invention describes a cosmetic case having a tray that can be refilled or replaced. The invention is particularly adapted for cosmetic compacts.

Figure 1:
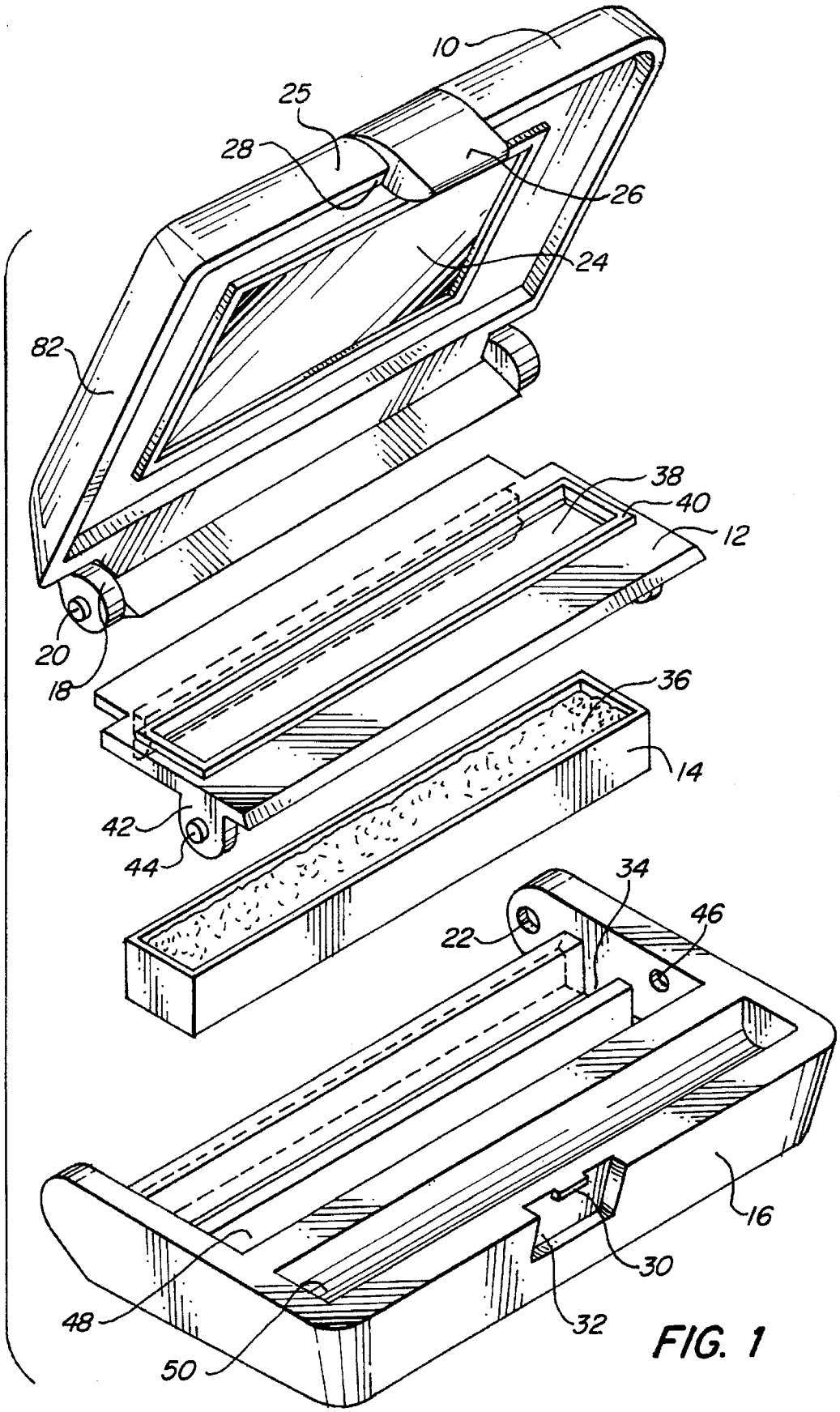
FIG. 1 is a perspective exploded view of an embodiment of a cosmetic case of the invention.

With reference to FIG. 1, illustrating an overall side front perspective view of the components of a typical cosmetic case of the invention, the basic structure comprises a lid 10, a tray retaining cover 12, a cosmetic tray 14 which can be replaced or refilled, and a base 16 sized and shaped to dimensionally correspond to the lid. The case can be plastic, metal or any other material or material mixtures known to those skilled in the art. Plastic is used in most embodiments. Most embodiments also have a mirror 24 anchored inside the lid 10 using glue, snap-fit retaining fingers, or the like.

When the case is assembled, lid 10 is attached to base 16 by means of a rear hinge. In the Figure, the rear hinge is formed by molding or shaping the two rear corners of the lid into shallow cylinders 18 so that the lid can pivot open or closed when projecting pins 20 on each side are inserted into pin orifices 22 in the base, but the case functions equally well with a metal or plastic hinge pin or other functionally equivalent hinge assembly.

Opposite the rear hinge, the lid front 25 engages the base by means of a latch, illustrated in the Figure as clasp 26. Similar to many compact designs, the clasp has a notch 28 that accommodates catch stud 30 in the base 16 to secure the case when in the closed position. The case is opened by movement of catch 26 forward slightly so that notch 28 is disengaged from stud 30, and is closed by simply snapping the case shut. In the illustrated design, base 16 is shaped with recess 32 sized to accommodate clasp 26 to streamline the overall contours of the closed case, but any button, intermeshed flanges or other latch mechanism used in compacts may be employed. The latch means shown is preferred because of its simplicity, economy of manufacture, and ease of use.

Base 16 has at least one upwardly facing tray recess 34 sized to house cosmetic tray 14. Though not illustrated in the Figure, the recess may have ribs or raised protuberances on its side walls to secure tray 14 in place. The Figures depict tray recess 34 as rectangular, but it can be round, square, or any other desirable shape, particularly preferred in embodiments comprising one large tray recess 34 housing one tray 14 for powder, blush, and the like. Moreover, in alternate embodiments such as that illustrated in FIG. 5, tray recess 34 may be sized to accommodate correspondingly sized multiple trays 14 for more than one cosmetic such as several eyeshadow colors. Alternatively, the base may contain multiple tray recesses 34, to contain multiple trays 14 such as for eyeshadows of different colors, or to contain powder and blush and the like, such as the two illustrated in FIG. 5. These embodiments typically have two or three tray recesses 34 and correspondingly sized trays 14. Tray 14 (or multiple trays shown in FIGS. 5 and 6) containing powder, blush, rouge, eyeshadow or other cosmetic material 36 fits snugly into recess 34 by installation in the base along the vertical unevenly dashed line. When the cosmetic case is refilled, tray (or trays) 14 can be removed as described below, and either refilled, or replaced with a replacement tray 14 having the same dimensions.

Figure 5:
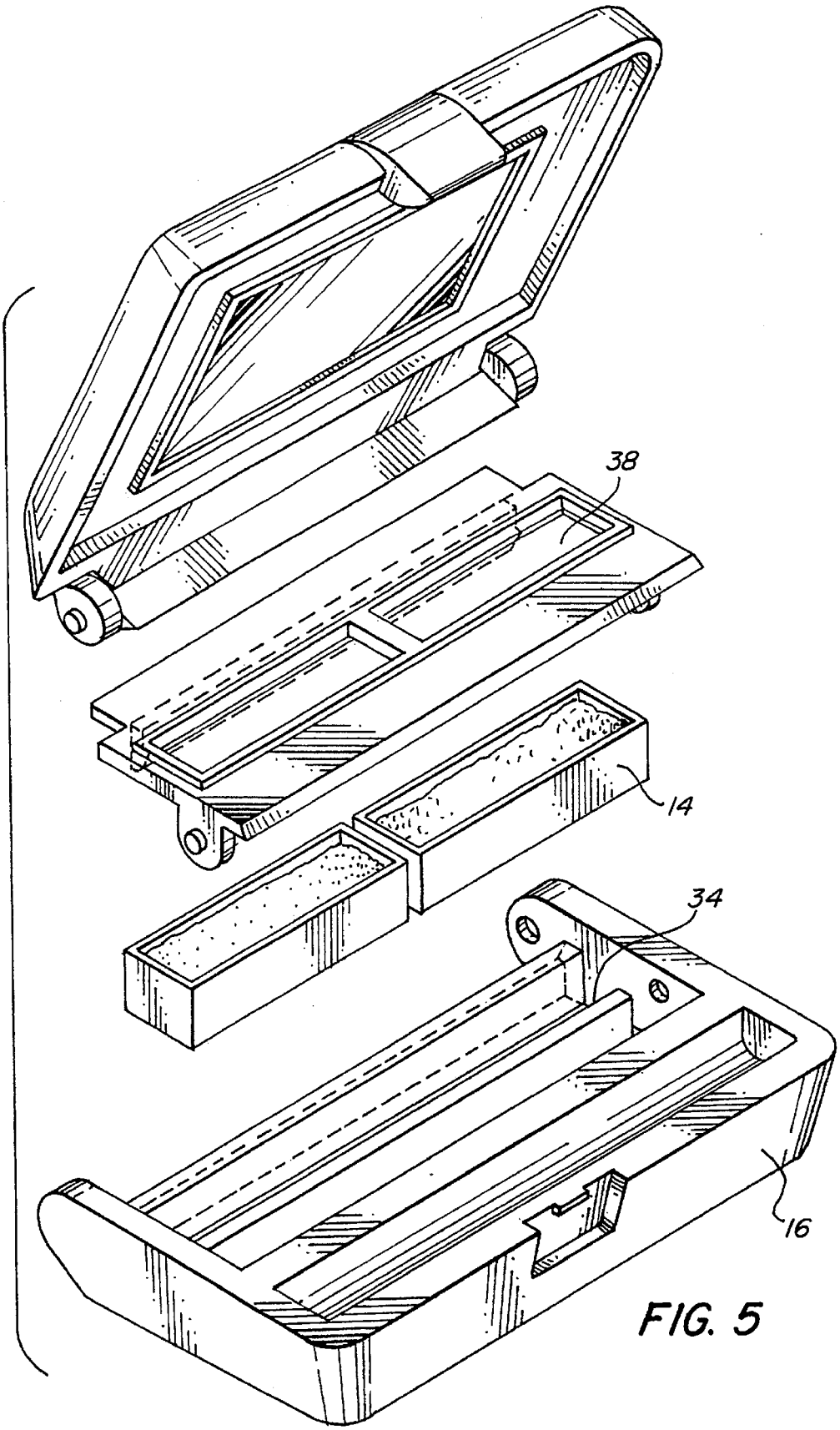
FIG. 5 is a perspective exploded view of another embodiment of a cosmetic case of the invention.
Figure 6:
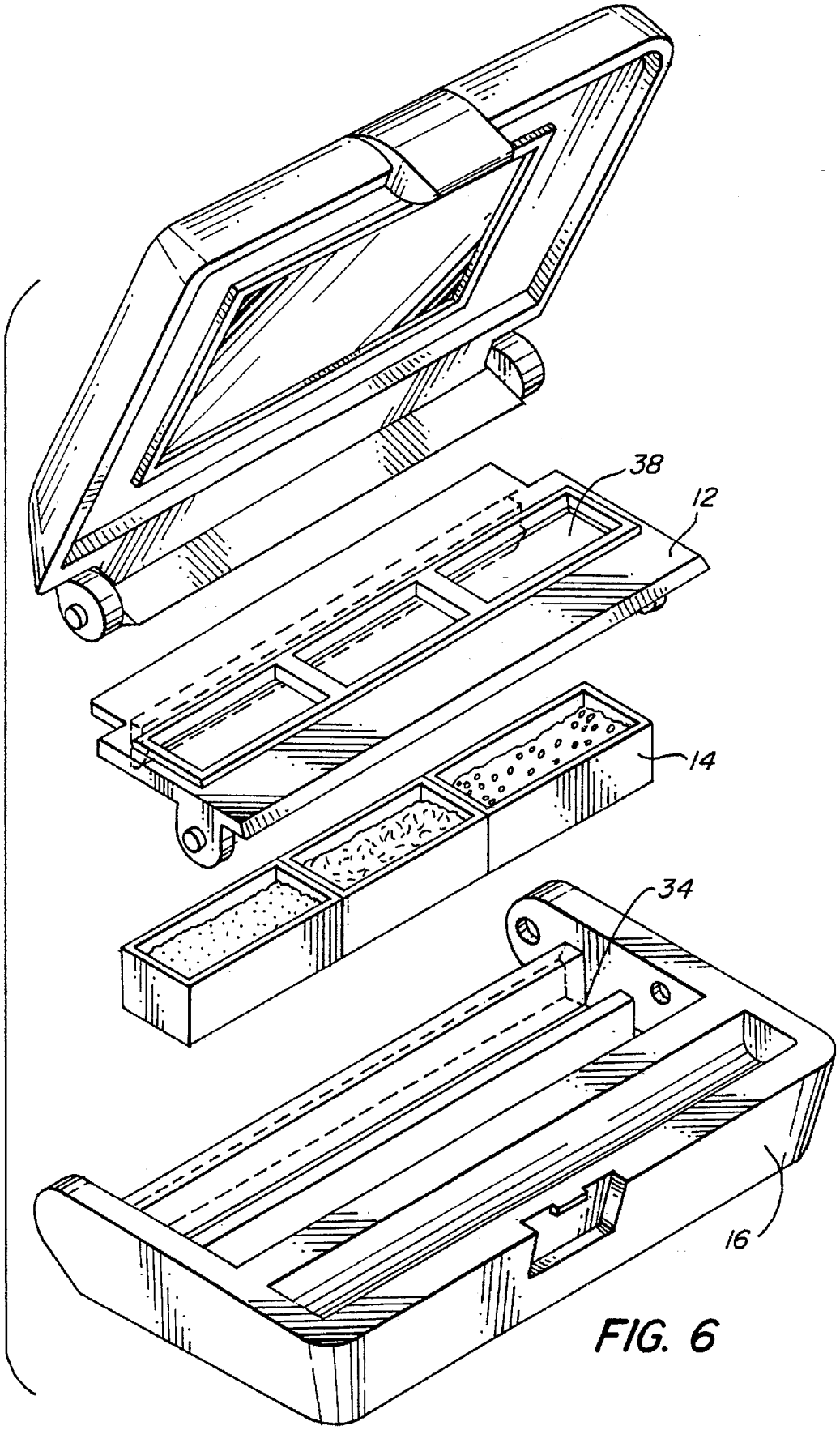
FIG. 6 is a perspective exploded view of a third embodiment of a cosmetic case of the invention.

Shallow cup-like tray 14 (or multiple trays as illustrated in FIG. 5) is held into place in recess 34 by tray retaining cover 12, which has an aperture 38 the size of the open end of the tray (or multiple apertures not shown) in a manner more fully described below. The Figures illustrate a rim 40 around the circumference of aperature 38, but this is not necessary for the function of the refillable cosmetic case of the invention. To hold cosmetic tray (or trays) 14 in place, tray retaining cover 12 is attached to base 16 by means of a hinge. In the Figure, the hinge is formed by inserting pins 44 situated on lower semi-circular member 42 on or near the two corners of the front edge of cover 12 into base orifices 46. Hinge recess 48 in base 16 is sized so that when retaining cover 12 is installed in base 16, it can pivot open on pins 44 as described below, so that cosmetic tray 14 (or multiple trays) can be lifted out for refilling or replacement. Though the hinge design illustrated is preferred for ease of manufacture and use, any comparable hinge design can suffice in the practice of the invention, including, but not limited to, metal pins, plastic pins, and living hinges.

Figure 2:
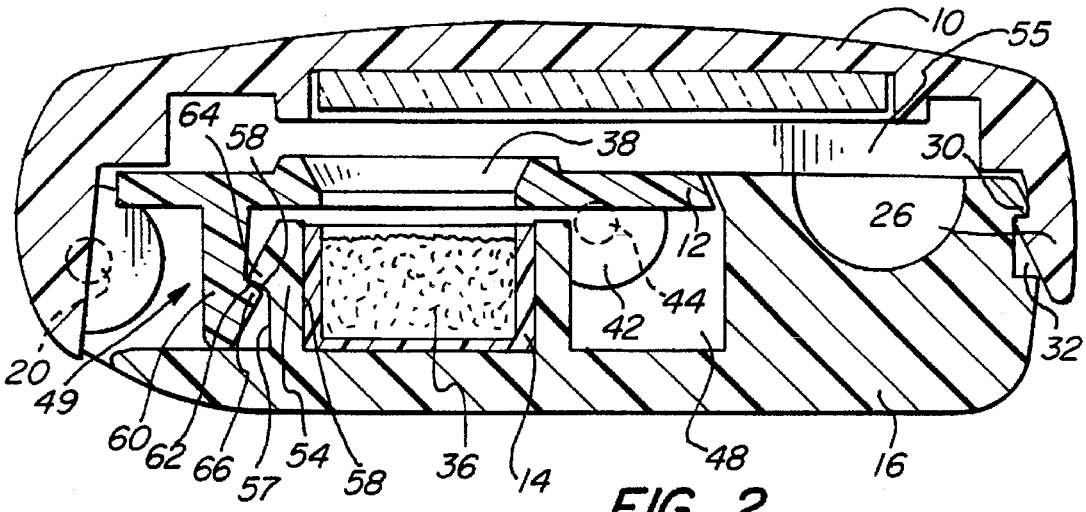
FIG. 2 is a horizontal cross-sectional view of an embodiment of a closed cosmetic case of the invention.

FIG. 2 shows a horizontal cross-sectional view of a closed cosmetic case of the invention. As described above, clasp 26 is engaged with catch stud 30 and rests in recess 32 to secure lid 10 to base 16, holding the case shut. Tray retaining cover 12 holds tray 14 containing cosmetics 36 in place. Hollow 55 in lid 10 allows room for a powder puff or other cosmetic applicator.

As summarized above, tray retaining cover 12 is held hingedly to base 16 by pins 44 on front edge semi-circular cover members 42 that move in hinge recess 48 when the cover is released. Cover 12 is held at its opposite edge by a latching element 49 at the rear of the case.

The latching element 49 illustrated comprises a coupling between the back wall 54 of the tray recess 34 with retaining cover member 60. Member 60 extends perpendicularly from cover 12 and is located on the cover so that it comes into juxtaposition with the rear face of back wall 54 of the base. Base back wall 54 is sized on its front face 56 to accommodate the shape of tray 14 and rests against it; in the Figure, it is perpendicular to the bottom of base 16. (In some embodiments with flared cosmetic trays, it is sloped to accommodate their shape.) Rear face 57 of back wall 54 has a flange 64 with a downwardly facing surface 58 that abuts upwardly facing surface 62 of corresponding flange 66 in perpendicular extending member 60 of cover 12 in the closed position. It can be seen from the drawing that this relationship meshes flanges 64 and 66 when the tray cover is in place in a closed position, so that recess back wall 54 is fastened to member 60, holding the tray cover 12 to the base 16 at the inside rear of the case.

Figure 3:
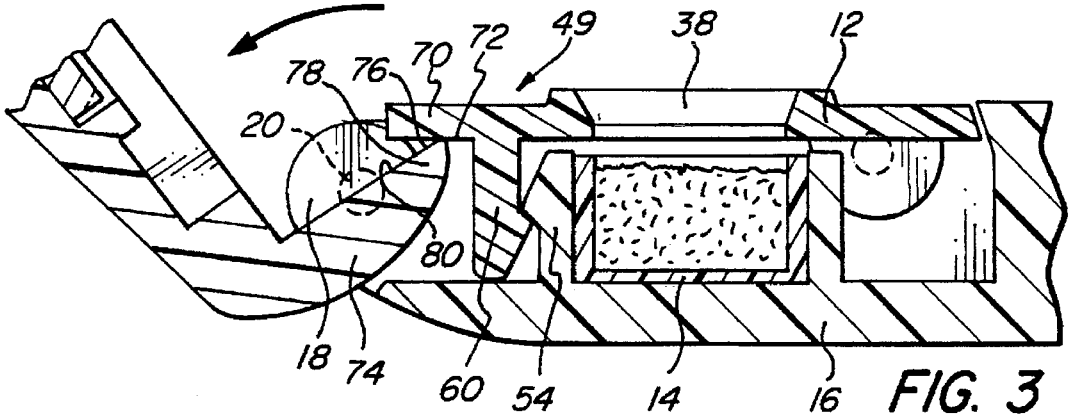
FIG. 3 is a fragmentary horizontal cross-sectional view comparable to FIG. 2, but showing the lid opened to its full extent for normal use when cosmetics are dispensed from the case.

FIG. 3 gives a fragmentary horizontal cross-sectional view showing lid 10 pivoted open on pins 20 to its full extent for normal use when cosmetics are dispensed from the case. Both base 16 and tray cover 12 are in the same respective positions as when the case is closed, i.e., generally parallel to one another, and members 60 and 54 remain meshed, so cosmetic tray 14 is held in place. Inside end surface 76 of lid tip 78 in the lid rear portion 74 rests against, but does not push against, lower face 72 of tray cover portion 70 extending beyond latching element member 60. For ordinary use, the contact of lid tip 78 with tray cover portion 70 halts progress of the lid 10 as it is opened.

It should be pointed out that the Figures show a streamlined case having lid 10 pivot open on pins 20. As shown in FIG. 1, cylindrically shaped members 18 that bear pins 20 forming the case hinge are thus recessed from side edge 82 of the lid. In other embodiments (not shown), the cylindrically shaped members or other hinge means may be flush with the lid sides, so that lid tip 78 extends the length of the case. That design or others functionally similar are encompassed by the invention, so long as surface 76 is presented with lower surface 72 of tray cover portion 70 so that the lid acts as a cam means as described below. The Figures illustrate the preferred embodiment, which, when assembled, is a streamlined case.

Figure 4:
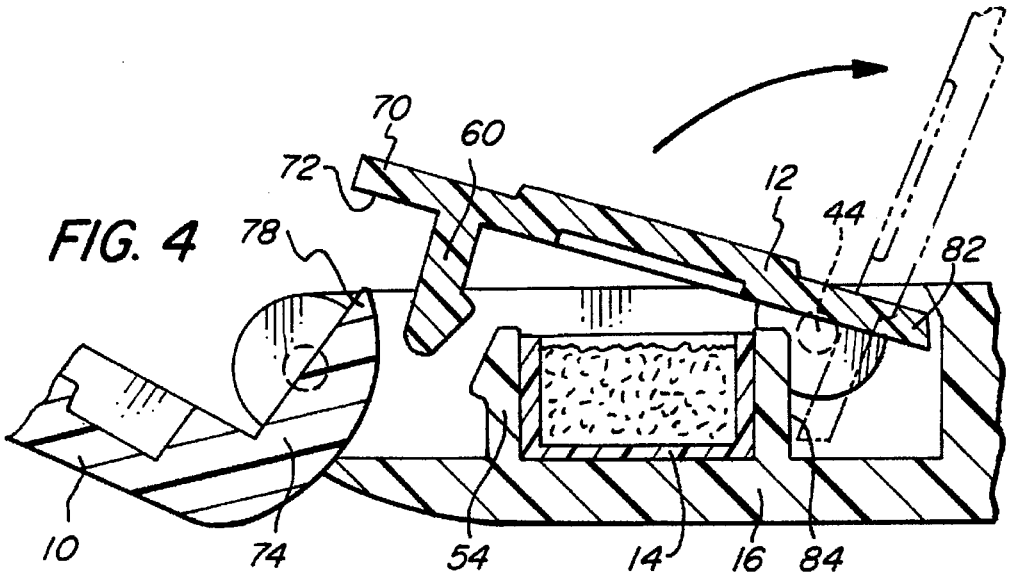
FIG. 4 is a fragmentary horizontal cross-sectional view comparable to FIG. 3, but showing the lid opened beyond its usual limit of travel to release a latching element so that the tray retaining cover can be fully opened by swinging it back (to the extent of the broken lines), to allow for easy tray replacement.

FIG. 4 shows a fragmentary horizontal cross-sectional view comparable to FIG. 3, but showing the lid 10 opened beyond its usual limit of travel. This is accomplished simply by continuing to open lid 10 after it is halted by lid rear tip 78 coming into contact with tray cover end 70. Further opening pushes rear tip 78 against tray cover end 70, the former acting as a cam, and they separate, releasing the latching element formed by intermeshed base recess wall member 54 and tray cover member 60. The members pull apart as illustrated. The entire tray retaining cover 12 pivots back on pins 44 set in base orifices 46 described above, exposing cosmetic tray 14.

In the pivoting of cover 12, front portion 82 of cover 12 swings into base tray cover recess 50 as far as the back wall 84 of the recess. The extent of travel of the cover is thus defined by the geometry of the recess as illustrated by the broken lines in the Figure. Once the tray cover is open, tray 14 can be easily lifted out and refilled or replaced.

It is an advantage of the invention that the overall mechanism is very easy to operate, requiring no fumbling with tiny buttons or release catches, dismantling of snapped components, and the like. The user simply opens the compact beyond its usual limit of travel and refills it.

The above description is for the purpose of illustrating and not limiting the present invention, and teaching the person of ordinary skill in the art how to practice the invention. It is not intended to detail all those obvious modifications and variations of it which will become apparent to the skilled worker upon reading the description. It is intended, however, that all such obvious modifications and variations be included within the scope of the present invention as defined in the appended claims.

I claim:

1. A cosmetic case comprising: an open base having an upwardly facing recess, a cosmetic tray releaseably retained in the recess, a tray retaining cover hinged in the base and having a latching element to hold the tray retaining cover in a closed position, and a lid hinged to the base at a rear edge opposite the tray retaining cover hinge and having a cam means, whereby when the lid is opened beyond its usual limit of travel the cam means contacts and releases the latching element of the tray retaining cover.

2. A case according to claim 1 wherein the cam means comprises a tip portion at the rear edge of the lid that pushes against the underside of a rear portion of the tray cover, releasing the latching element to permit the tray cover to be pivoted to an open position.

3. A case according to claim 2 wherein the latching element comprises a perpendicular member on the tray cover that has a flange that meshes with a flange on a rear wall of the upwardly facing recess.

4. A case according to claim 1 wherein both lid and cover hinges comprise hinge pins fitted into pin orifices in the base.

5. A case according to claim 1 wherein the base recess accommodates multiple cosmetic trays.

6. A case according to claim 5 wherein the base recess accommodates multiple cosmetic trays selected from the group consisting of two cosmetic trays and three cosmetic trays.

7. A cosmetic case comprising a lid, a cosmetic tray retaining cover, a cosmetic tray, and a base, wherein the tray retaining cover is hinged to the base near the front of the case and has a rear portion bearing a perpendicular member which releasably latches to a back wall of the base to hold the tray in place, said rear portion also having an edge that is acted on by a rear tip of the lid when the lid is opened, lifting the tray cover if the lid is opened beyond its usual travel, and pivoting the tray cover on its hinge to expose the tray for a refill or replacement.

8. A case according to claim 7 wherein the base recess accommodates multiple cosmetic trays.

9. A case according to claim 7 wherein both lid and cover hinges comprise hinge pins fitted into pin orifices in the base.

10. A case according to claim 8 wherein the base recess accommodates multiple cosmetic trays selected from the group consisting of two cosmetic trays and three cosmetic trays.

11. A cosmetic case comprising:

(a) an open base having an upwardly facing recess, a cosmetic tray releaseably retained in the recess;

(b) a tray retaining cover hinged in the base and having a latching element comprising a perpendicular member on the tray cover that has a flange that meshes with a flange on a rear wall of the upwardly facing recess to hold the tray retaining cover in a closed position; and (c) a lid hinged to the base at a rear edge opposite the tray retaining cover hinge and having a tip portion at the rear edge of the lid, whereby when the lid is opened beyond its usual limit of travel the tip portion pushes against the underside of a rear portion of the tray cover, releasing the latching element to permit the tray cover to be pivoted to an open position.

12. A case according to claim 11 wherein the base accommodates two cosmetic trays.

13. A case according to claim 11 wherein the base accommodates three cosmetic trays.

* * * * *